US007792451B2

(12) United States Patent
Kim et al.

(10) Patent No.: US 7,792,451 B2
(45) Date of Patent: Sep. 7, 2010

(54) IMAGE FIXING APPARATUS, IMAGE FORMING APPARATUS USING THE SAME, AND IMAGE FIXING TEMPERATURE CONTROL METHOD THEREOF

(75) Inventors: Jin-ha Kim, Seongnam-si (KR); Joon-gi Kwon, Gunpo-si (KR); Jong-moon Choi, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 209 days.

(21) Appl. No.: 11/877,788

(22) Filed: Oct. 24, 2007

(65) Prior Publication Data

US 2008/0279576 A1 Nov. 13, 2008

(30) Foreign Application Priority Data

May 7, 2007 (KR) ..... 10-2007-0043968

(51) Int. Cl.
*G03G 15/20* (2006.01)

(52) U.S. Cl. ..... 399/69; 399/333; 219/216

(58) Field of Classification Search ..... 399/328, 399/330, 333, 69; 492/46, 53; 219/216
See application file for complete search history.

(56) References Cited

U.S. PATENT DOCUMENTS 6,794,611 B2 * 9/2004 Kataoka et al. ..... 219/216
7,218,873 B2 * 5/2007 Iwasaki et al. ..... 399/68

FOREIGN PATENT DOCUMENTS

JP 01307785 A * 12/1989
JP 9-266058 10/1997
JP 11-251042 9/1999

* cited by examiner

*Primary Examiner*—David M Gray
*Assistant Examiner*—Barnabas T Fekete
(74) *Attorney, Agent, or Firm*—Staas & Halsey LLP

(57) ABSTRACT

An image fixing apparatus that senses temperature of a heater and controls the temperature accurately includes a pair of fixing rollers, a heater housed inside at least one of the pair of fixing rollers, and a sensor integrally formed with the heater to detect temperatures of the heater from a plurality of sensing positions. The sensor includes an array of sensing units connected in parallel to the plurality of sensing positions, and generates one sensing signal. An image forming apparatus includes the image forming apparatus. An image fixing temperature control method includes generating average temperature information of a heater; and controlling the driving of the heater based on the temperature information.

13 Claims, 5 Drawing Sheets

IMAGE FIXING APPARATUS, IMAGE FORMING APPARATUS USING THE SAME, AND IMAGE FIXING TEMPERATURE CONTROL METHOD THEREOF

CROSS-REFERENCE TO RELATED APPLICATION

This application claims the benefit of Korean Application No. 2007-43968, filed May 7, 2007 in the Korean Intellectual Property Office, the disclosure of which is incorporated herein by reference.

BACKGROUND OF THE INVENTION

1. Field of the Invention

Aspects of the present invention relate to an image forming apparatus, and more particularly, to an image fixing apparatus to fix an image onto a printing medium, an image forming apparatus having the same, and an image fixing temperature control method thereof.

2. Description of the Related Art

An image forming apparatus, such as, for example, a multi-function image forming apparatus that combines various functions such as a copier, a printer, or a facsimile, mainly operates to recreate an input image signal onto a printing medium. An image forming apparatus generally includes a paper feeder to feed a printing medium, a developer to develop an electrostatic latent image on a photoconductive medium, a transfer mechanism to transfer the developed image onto the printing medium, and an image fixing apparatus to fix the transferred image in the printing medium. An example of a conventional image fixing apparatus is illustrated in FIG. 1.

Referring to FIG. 1, a conventional image fixing apparatus 1 of an image forming apparatus includes a heating roller 10, which houses a heater 11 therein, and a pressing roller 20, which is pressed towards the heating roller 10. A temperature sensor 30 is installed on the outer circumference of the heating roller 10 to measure the temperature of the heating roller 10.

A thermal sensor (such as a thermistor or thermostat) is generally used as the temperature sensor 30. The temperature sensor 30 detects the surface temperature of the heating roller 10, generally from a spot near the middle part of the heating roller 10. Therefore, the temperature of the heater 11 is controlled according to the result of the sensing by the temperature sensor 30.

However, because the temperature sensor 30 is installed on the outer surface of the heating roller 10 while the heater 11 is inside the heating roller 10, it is difficult to detect accurately the temperature of the heater 11. Accordingly, it is difficult to control the temperature of the heater 11 accurately, and bad image fixation may occur due to overheating or underheating of the heater 11.

FIG. 2 shows a temperature variation along an axis of the roller 10 both at an early stage in an operation of the image fixing apparatus (below $T_0$) and at a later stage of the operation of the image fixing apparatus (above $T_0$). In FIG. 2, S.P. represents a position at or near a midpoint of the axis where the temperature sensor 30 detects the temperature of the heater 11. $T_1$ represents the early stage temperature variation in the absence of control and $T_2$ represents the early stage temperature variation, where the temperature is controlled to bring the temperature at S.P. up to the reference temperature $T_0$. $T_3$ represents the later stage temperature variation in the absence of control and $T_4$ represents the later stage temperature variation, where the temperature is controlled to bring the temperature at S.P. down to the reference temperature $T_0$. Because the temperature sensor 30 detects the temperature at only one spot (S.P) at or near the middle part of the heating roller 10, as illustrated in FIG. 2, and since the middle (S.P.) of the roller 10 tends to heat up more quickly than the ends of the roller, a large temperature gap ($\Delta T_1$) is generated at the ends of the roller 10 between the previously fixed reference temperature ($T_0$) and the controlled temperature ($T_2$) at the early stage operation, even when the middle of the roller has reached the reference temperature $T_0$. Similarly, since the middle S.P. of the roller 10, tends to lose heat more quickly than the ends of the roller 10, a large temperature gap ($\Delta T_2$) is generated at the ends of the roller 10 between the previously fixed reference temperature ($T_0$) and the controlled temperature ($T_4$) after a long period of operation.

In particular, a large temperature gap ($\Delta T_1$) occurs between the lowest value of the controlled early stage temperature of the early stage temperature ($T_2$) and the predetermined image fixing reference temperature ($T_0$). A large temperature gap ($\Delta T2$) also occurs between the highest value of the controlled long time operation temperature ($T_4$) and the predetermined image fixing reference temperature ($T_0$). The temperature gaps ($\Delta T_1$, $\Delta T2$) cause problems such as over-fixing, under-fixing, or shortened lifespan.

It has thus been proposed that the first image fixing on the printing medium P by the image fixing apparatus 1 be shortened by reducing the heating volume so that the heater 11 can reach a desired high temperature to heat the heating roller 10 within a short time. In this case, however, if the temperature is sensed inaccurately by the temperature sensor 30, the heater 11 may be damaged.

SUMMARY OF THE INVENTION

Aspects of the present invention provide an image fixing apparatus which senses temperature of a heater accurately, and thus is able to control the heater with accuracy, an image forming apparatus having the image fixing apparatus, and a fixing temperature control method thereof.

According to an embodiment of the present invention, an image fixing apparatus of an image forming apparatus is provided. The image fixing apparatus includes a pair of fixing rollers, a heater housed inside at least one of the pair of fixing rollers, and a sensor integrally formed with the heater, to detect temperatures of the heater from a plurality of sensing positions.

According to another aspect of the present invention, the sensor includes an array of sensing units connected in parallel to the plurality of sensing positions, and generates one sensing signal.

According to another aspect of the present invention, an insulating member may be disposed between the heater and the sensor.

According to another aspect of the present invention, the heater may include a multi-layer heating body, and the sensor may be disposed between the layers of the heating body.

According to another aspect of the present invention, the sensor may detect temperatures of the heating body from at least two sensing positions.

According to another aspect of the present invention, the heater and the sensor may be mixed with each other by ceramic processing.

According to another aspect of the present invention, the array of sensors generate average temperature information of a plurality of sensing positions.

According to another aspect of the present invention, a switch may further be provided, to control the on/off status of the heater, based on a comparison between the average temperature information generated from the sensor and a reference temperature.

According to another aspect of the present invention, the switch controls the on/off status of the heater so that the average temperature corresponds to the reference temperature.

According to another embodiment of the present invention, an image forming apparatus is provided. The image forming apparatus includes an image forming section to form an image on a printing medium, and an image fixing apparatus to fix the image into the printing medium, wherein the image fixing apparatus includes a pair of fixing rollers, a heater housed inside at least one of the pair of fixing rollers, a sensor including a plurality of sensing units connected in parallel to detect temperatures of the heater from a plurality of sensing positions, and a switch to control the on/off status of the heater based on information detected at the sensor.

According to another embodiment of the present invention, a method of controlling an image fixing temperature of an image forming apparatus is provided. The method may include generating average temperature information from a plurality of sensing positions of a heater, and controlling driving of the heater based on the temperature information.

According to an aspect of the present invention, the generating may include sensing, by an array of sensing units connected in parallel, temperatures of the heaters from a plurality of sensing positions, and computing an average temperature based on temperature information sensed from the plurality of sensing positions.

According to an aspect of the present invention, the controlling may include comparing the average temperature with a reference fixing temperature, and switching off the heater if the average temperature exceeds the reference temperature, and switching on the heater, if the average temperature is lower than the reference temperature.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
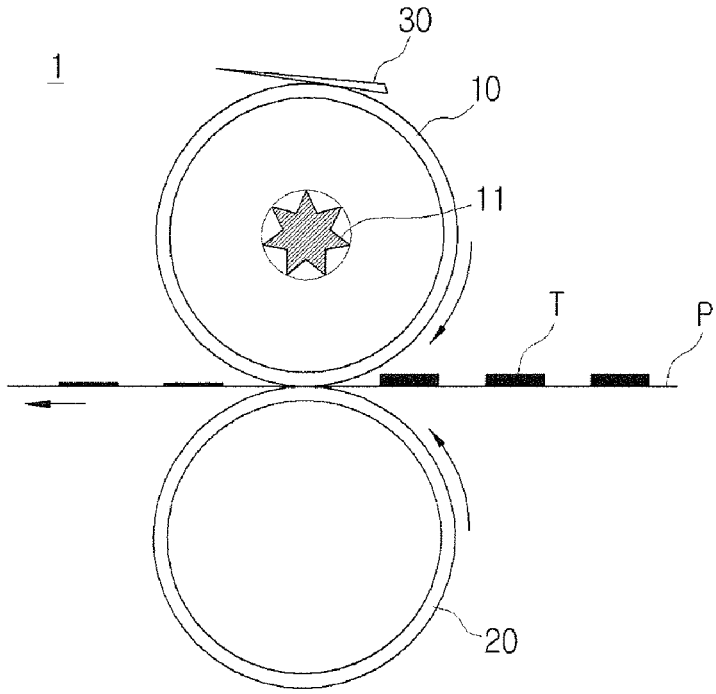
FIG. 1 (PRIOR ART)
FIG. 1 is a schematic cross sectional view illustrating a conventional image fixing apparatus of an image forming apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
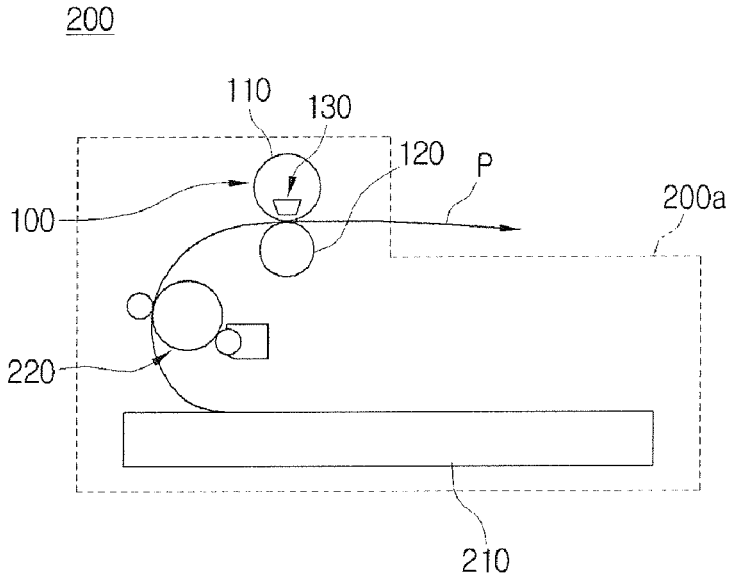
FIG. 3 is a schematic cross-sectional view an image forming apparatus according to an exemplary embodiment of the present invention.

Referring to FIG. 3, an image forming apparatus 200 according to an embodiment of the present invention includes an image forming section 220 and an image fixing apparatus 100. A paper cassette 210 is removably attached to a main body 210*a* of the image forming apparatus 200. The image forming section 220 develops an image on a printing medium P. The paper cassette 210 and the image forming section 220 have substantially the same technical construction as is known in the art, and therefore, a detailed explanation thereof will be omitted for the sake of brevity. Moreover, the cassette 210 can be replaced by a tray or manual feed slot in other aspects. The image fixing apparatus 100 will be explained in detail below, with reference to the accompanying drawings.

Referring to FIGS. 4 to 6A, the image fixing apparatus 100 includes a heating roller 110, a pressing roller 120, a heater 130, a sensor 140 and a switch 170.

The heating roller 110 and the pressing roller 120 rotate in contact with each other. One of the heating roller 110 and the pressing roller 120 receives force from a driving source (not shown) to be driven. The other roller, which does not receive force from the driving source (not shown), is passively rotated by contact with the counterpart roller receiving the driving force. In order to support the rotation of the heating roller 110 and the pressing roller 120, both ends of the heating roller 110 and the pressing roller 120 are supported by bearings (not shown). However, the above example is not limiting. Many alternative embodiments are possible. For example, both the heating roller 110 and the pressing rollers 120 may receive driving force from the driving source (not shown) to be rotated.

The heating and pressing rollers 110, 120 are formed from materials such as stainless steel and are coated on their outer circumferences with materials such as Teflon, to prevent the toner image T formed on a printing medium P from passing onto the heating and pressing rollers 110, 120, when the printing medium P passes between the heating and pressing rollers 110, 120.

The pressing roller 120 is squeezed towards the heating roller 110 in a rotating motion, thereby creating a nip area N between the heating and pressing rollers 110, 120. Accordingly, both ends of the pressing rollers 120 are supported by an elastic member such as a spring (not shown).

The heater 130 is housed inside the heating roller 110, to heat the heating roller 110 at a predetermined fixing temperature. The heater 130 includes a heating body 131 and a support member 132 to support the heating body 131.

As a non-limiting example, the heating body 131 may be a resistor, which generates heat from externally-supplied electricity. However, it is to be understood that other types of heat-generating elements may be used. The heating body 131 is extended in a direction along an axis of rotation of the heating roller 110, and transmits heat to the inner circumference of the heating roller 110 by radiation.

Figure 5:
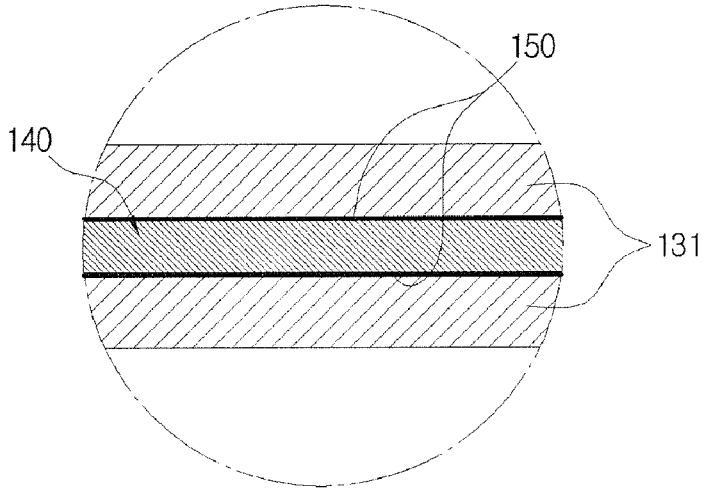
FIG. 5 is an enlarged view of an area in circle A of FIG. 4.

Referring to FIG. 5, the heating body 131 has a multi-layer structure, that is, the heating body 131 has a plurality of layers.

The support member 132 supports the heating body 131 so that the heating body 131 is spaced apart from the inner side of the heating roller 110 and faces the pressing roller 120.

In other words, the support member 132 supports the heating body 131 so that the heating body 131 is maintained close to the nip area N formed between the heating roller 110 and the pressing roller 120. As a result, heat generated at the heating body 131 is transmitted to the nip area N within a short time. The sensor 140 is integrally formed with the heater 130, to sense temperatures of the heater 130 at a plurality of sensing positions. Referring to FIG. 5, the sensor 140 is disposed between the layers of the heating body 131. An insulating member 150 is disposed between the sensor 140 and the heater 130 for electric insulation.

Figure 6A:
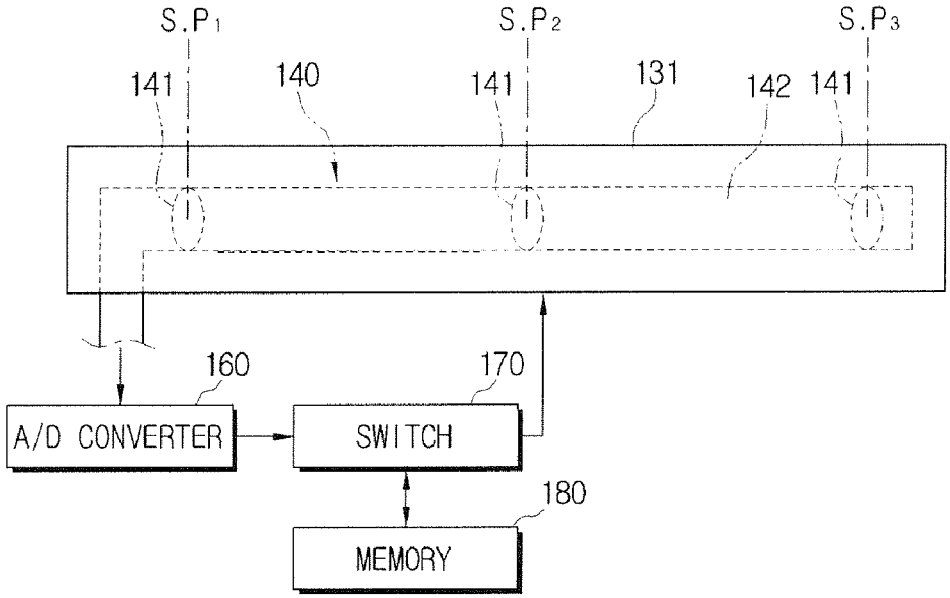
FIGS. 6A and 6B are schematic representations a heating body and a sensor of the image fixing apparatus of FIG. 4.
Figure 6B:
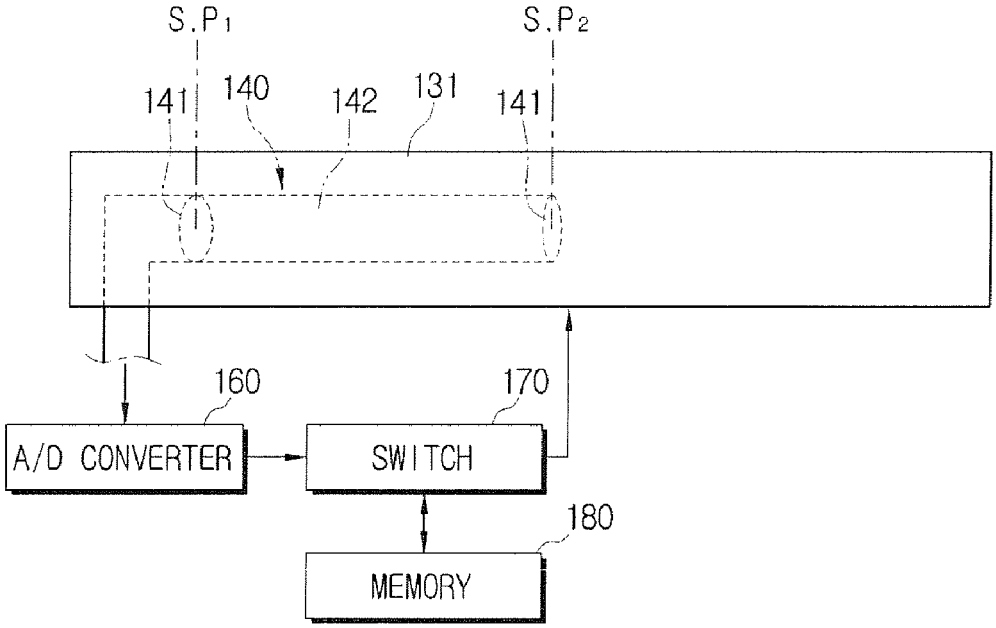

Referring to FIG. 6A, the sensor 140 includes sensing units 141 to detect the temperatures of the heating body 131 at least three sensing positions. The sensing units 141 are spaced a predetermined distance away from each other along the axis of the heating roller 110, to correspond to the heating body 131, which extends along the axis of the heating roller 110. However, it is to be understood that fewer or more sensing units 141 can be used and that the relative placement of the sensing units 141 to each other can be varied and need not be equal distances as shown.

A conductive member 142, such as, for example, a wire, connects the sensing units 141 in parallel, to enable the exchange of electric signals. In other words, an array type sensor, in which a plurality of sensing units 141 are connected by one conductive member 142 in a parallel relation, may be implemented. As the sensing units 141 detect the temperatures, an average temperatures is also computed and output.

The sensing units 141 may be thermal sensors, such as thermistors, which change resistance value or generate electricity in response to heat.

Referring to FIG. 6A, the sensing units 141 are connected in parallel to first to third sensing positions ($S.P_1$, $S.P_2$, $S.P_3$) at equal intervals. However, it is to be understood that other numbers of sensing units and other configurations of the sensing units may be used. For example, as an alternative, the sensing units 141 may be connected in parallel to first and second sensing positions ($S.P_1$, $S.P_2$) of the heating body 131.

The sensor 140 including the sensing units 141, and the heater 130 may be mixed integrally with each other by ceramic processing to form the ceramic support member 132 to hold the heating body 131 and the sensor 140. Accordingly, the support member 132 that supports the heating body 131 and the sensor 140 may be made from a ceramic material having highly insulating and non-thermal characteristics and low heat resistance.

The switch 170 controls the on/off status of the heating body 131, based on the average temperature sensed from the sensor 140. As the average temperature of the heating body 131 is computed by the sensor 140, the switch 170 compares the average temperature with a reference temperature $T_0$. Accordingly, the switch 170 may exchange signals with a memory 180 that stores the reference temperature $T_0$.

If the average temperature exceeds the reference temperature $T_0$, the switch 170 turns off the heating body 131, so that the temperature of the heating body 131 decreases. If the average temperature is lower than the reference temperature $T_0$, the switch 170 keeps the heating body 131 in an "on" status, so that the temperature of the heating body 131 increases.

In other words, the switch 170 controls on/off status of the heating body 131 so that the average temperature corresponds to the reference temperature $T_0$. As such, the switch 170 may be implemented using a processor and/or computer to control at least the on/off status of the sensor 140.

An analog-to-digital converter 160 may be provided between the sensor 140 and the switch 170, to digitize the signal from the sensor 140 so that the switch 170 can read the average temperature generated from the sensor 140. The analog-to-digital converter 160 is connected with the array of sensing units 141, which are connected in parallel via a conductive member 142. Compared to serial sensors, which would require separate conductive members to connect an analog-to-digital converter 160 with individual serial sensing units, the above structure according to an embodiment of the present invention is simpler. The switch 170 compares the sensed temperature with the reference temperature $T_0$ stored in a memory 180 and accordingly controls the on/off state of the sensor 140.

The operation of the image forming apparatus having the image fixing apparatus, and the image fixing temperature control method according to the above embodiments of the present invention will be explained below, with reference to FIGS. 3 to 8.

Figure 4:
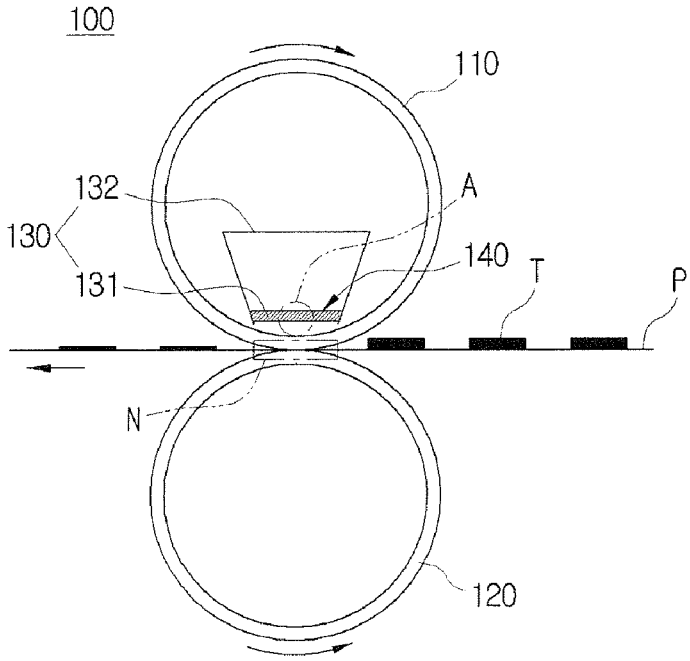
FIG. 4 is a schematic cross sectional view of the image fixing apparatus of FIG. 3.

Referring to FIGS. 3 and 4, the image forming section 220 forms an image on a printing medium P fed from the paper cassette 210. The printing medium P bearing the image is then conveyed between the heating roller 110 and the pressing roller 120 of the image fixing apparatus 100.

The heating roller 110 is heated by the fixing heat generated from the heating body 131, and the pressing roller 120 is squeezed against the heating roller 110 by the support of the elastic member (not shown). Accordingly, the nip area N is created on the heating roller 110 and the pressing roller 120 which are squeezed against each other. The printing medium P bears a developed image thereon, and the developed image is fixed in the printing medium P as the printing medium P passes the nip area N. The printing medium P is then discharged outside the main body 200*a* of the image forming apparatus.

The heating of the heating roller 110 will be explained in more detail below. The heating body 131 housed inside the heating roller 110 and facing the nip area N is heated. Heat is generated from the heating body 131, and radiated to the heating roller 110, which is rotated in tight contact with the pressing roller 120, thereby heating the heating roller 110. Because the heating body 131 is supported by the support member 132 to be close to the nip area N, the nip area N can be heated to a desired temperature faster than other areas.

Referring to FIG. 5, sensor 140 including the sensing units 141 is integrally formed between the layers of the heating body 131, to sense the heat generated from the heating body 131. However, it is to be understood that the sensor 140 could be otherwise disposed, such as above or below the heater 130 in other aspects.

The method of controlling the image fixing temperature of the heating body 131 according to an aspect of the invention will be explained below, with reference to FIGS. 7 and 8. Referring to FIG. 8, the sensor 140 detects the temperature of the heating body 131 and generates temperature information at operation S10. More specifically, the array of sensing units 141 connected in parallel sense the temperatures of the heating body 131 from the first to third sensing positions ($S.P_1$, $S.P_2$, $S.P_3$) as illustrated in FIGS. 6A and 7 at operation S11, and compute an average temperature at operation S12.

Figure 7:
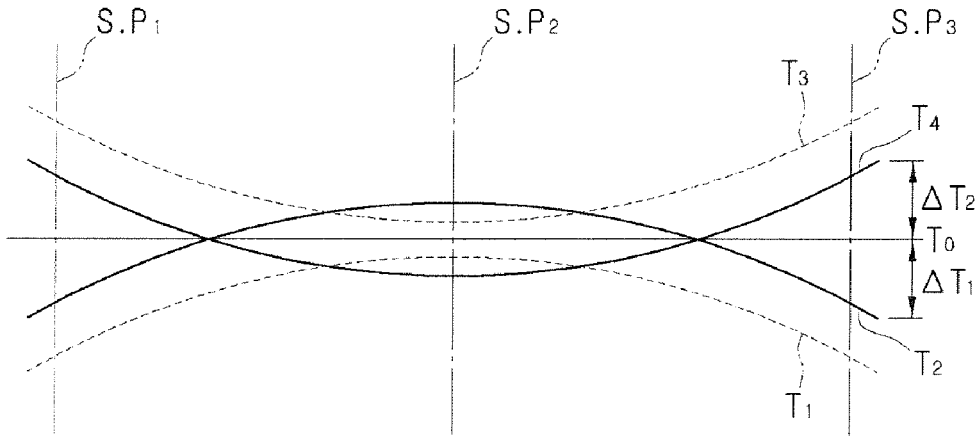
FIG. 7 is a graph that illustrates temperatures of the image fixing apparatus of FIG. 4 across a width of the heating roller.
Figure 8:
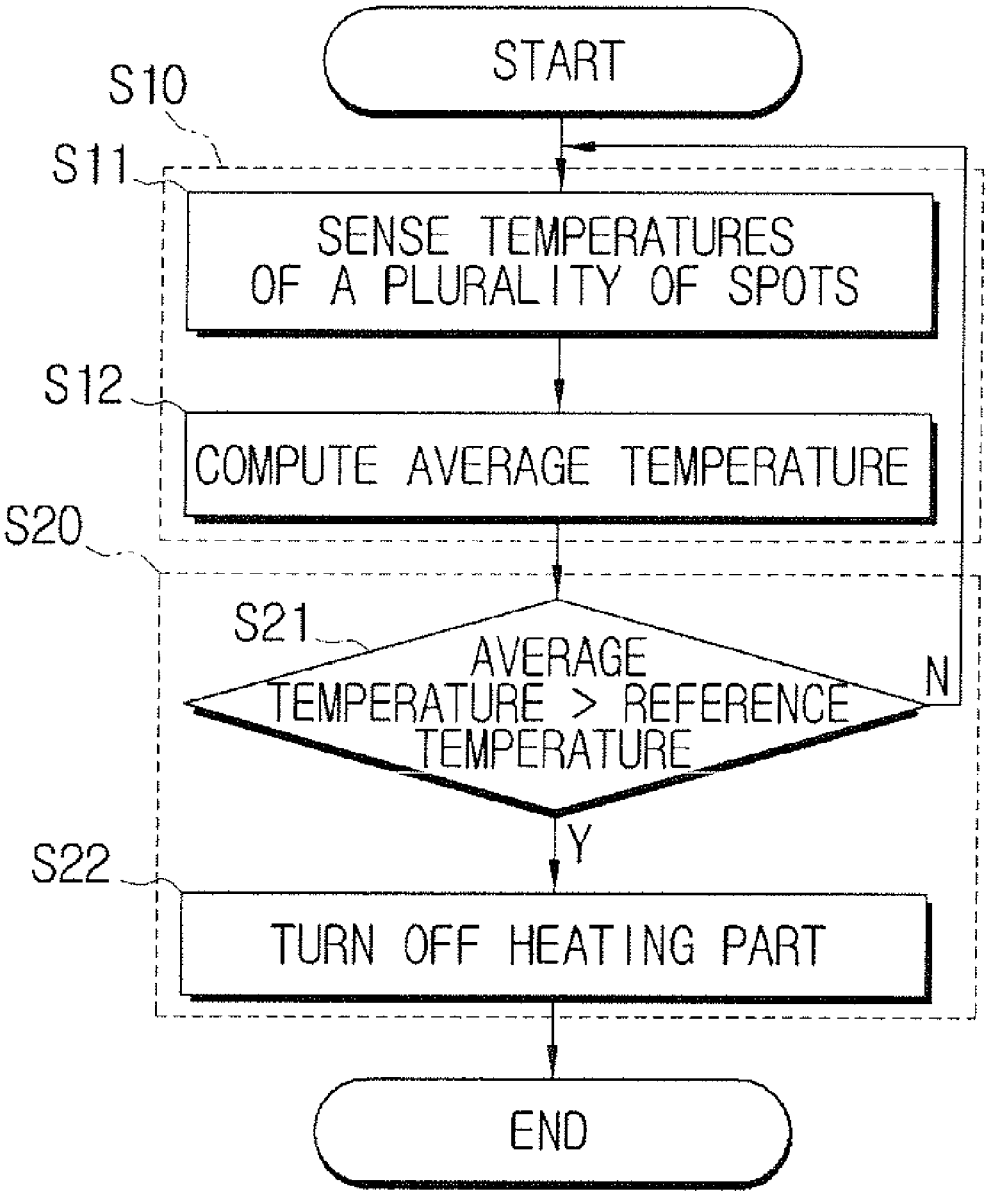
FIG. 8 is a flowchart illustrating an image fixing temperature control method of an image forming apparatus according to an exemplary embodiment of the present invention.

Referring to FIG. 7, the early stage temperature $T_1$ of the heating body 131 has a relatively higher temperature at the middle spot, corresponding to the second sensing spot (S. $P_2$), than at either end. When the image forming apparatus has been operated for a long time, the temperature at the middle spot is relatively lower than at each end. This is due to heat transfer to the printing medium P. Accordingly, driving of the heating body 131 is controlled at operation S20 according to the average temperature. The average temperature determined at the sensor 140 is digitized through the analog-to-digital converter 160 and transmitted to the switch 170.

The controlling at operation S20 will be explained in greater detail below. The switch 170 compares the average temperature with a reference temperature $T_0$ stored in the memory 180 at operation S21. If the average temperature exceeds the reference temperature, the heating body 131 is turned off so that the temperature of the heater begins to decrease. If the average temperature is lower than the reference temperature $T_0$, the heating body 131 keeps operating to reach the reference temperature $T_0$.

The switch 170 controls the on/off status of the heating body 131, so that the average temperature corresponds to the reference temperature $T_0$. By controlling the on/off status of the heating body 131 at operation S22, the early stage temperature $T_1$ is adjusted to a controlled early stage temperature $T_2$. After a long time operation, the long time operation temperature $T_3$ is adjusted to a controlled long time operation temperature $T_4$. As shown in FIG. 7, regarding the controlled early stage temperature $T_2$, the temperature at S.P.$_2$ may be higher than the reference temperature $T_0$ in order to provide an average controlled early stage temperature equal to the reference temperature $T_0$. Regarding the controlled long time operation temperature $T_2$, the temperature at S.P.$_2$ may be lower than the reference temperature $T_0$ in order to provide an average controlled early stage temperature equal to the reference temperature $T_0$.

Figure 2:
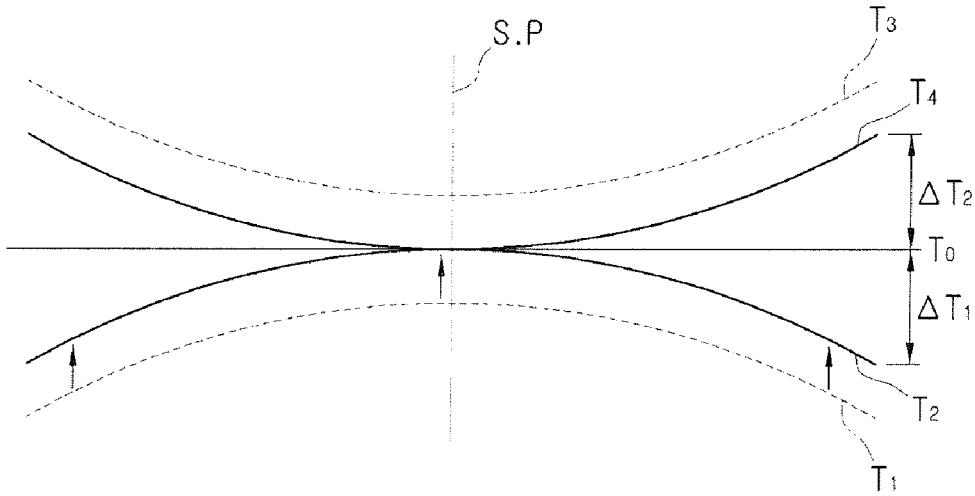
FIG. 2 (PRIOR ART)
FIG. 2 is a graph that illustrates temperatures of the image fixing apparatus of FIG. 1 across a width of the heating roller.

Accordingly, temperature gap ($\Delta T_1$) between the reference temperature $T_0$ and the controlled early stage temperature $T_2$, and temperature gap ($\Delta T_2$) between the reference temperature $T_0$ and the controlled long time operation temperature $T_4$ are relatively narrower than in the related art shown, for example, in FIG. 2. Compared to the related art where the temperature of the heating body 131 is detected approximately from the middle area alone, and controlled with reference to a reference temperature $T_0$, aspects of the present invention provide that the average temperature of the heater 131 is controlled with reference to the reference temperature $T_0$. Therefore, errors that may arise in the image fixing temperature can be resolved.

The sensing units 141 detect the temperature of the heating body 131 at various locations and compute an average temperature, irrespective of the on/off status of the switch 170. Accordingly, temperature of the heating body 131 is continuously detected and adjusted.

As explained above, according to embodiments of the present invention, by forming the heater 130 and the sensor 140 integrally, the temperature generated by the heater 130 can be detected with accuracy. Accordingly over-heating or under-heating, or breakage of the heater 130 can be prevented. Additionally, the fabrication process of the image fixing apparatus becomes simpler.

Furthermore, because the sensor 140 detects the temperature of the heater 130 from a plurality of sensing positions, the average temperature can be computed and the temperature of the heater can be controlled in accordance with the average temperature. As a result, a stable image fixing temperature can be provided, and subsequently, better image fixing and a longer life span are provided.

Furthermore, because the sensing units of the sensor are arranged in parallel to output only the average temperature, a simple structure and an economic price can be provided.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image fixing apparatus of an image forming apparatus, comprising:

a pair of fixing rollers biased towards each other;

a heater housed inside at least one of the pair of fixing rollers, and comprises a heating body comprising a plurality of heat generating layers;

a sensor is disposed between two of the heat generating layers of the heating body and integrally formed with the heater, to detect temperatures of the heater from a plurality of sensing positions on the heater, and an insulating member disposed between one of the heat generating layers of the heating body and the sensor;

wherein the sensor comprises an array of sensing units connected in parallel, each sensing unit detecting temperatures of one of the plurality of sensing positions, and wherein the sensor generates one sensing signal based upon plural detected temperatures.

2. The image fixing apparatus of claim 1, wherein the heater and the sensor are mixed with each other by ceramic processing such that the heater and sensor are integrally bound by a ceramic material.

3. The image fixing apparatus of claim 1, wherein the array of sensing units generate the average temperature information of the plurality of sensing positions.

4. The image fixing apparatus of claim 3, further comprising a switch to control an on/off status of the heater based on a comparison between the average temperature information generated from the sensor and a reference temperature.

5. The image fixing apparatus of claim 4, wherein the switch controls the on/off status of the heater part so that the average temperature corresponds to the reference temperature.

6. The image fixing apparatus of claim 1, wherein the pair of fixing rollers form a fixing nip and the heater housed inside the at least one of the pair of fixing rollers is located between an axis of the at least one of the pair of fixing rollers and the fixing nip.

7. The image fixing apparatus of claim 6, wherein the heater is elongated in an axial direction of the at least one of the pair of fixing rollers and wherein the sensor comprises sensing units that detect temperatures of a center, a first end and a second end of the heater.

8. An image forming apparatus, comprising:

an image forming section to form an image on a printing medium; and an image fixing apparatus to fix the image into the printing medium, wherein the image fixing apparatus comprises, a pair of fixing rollers biased towards each other, a heater housed inside at least one of the pair of fixing rollers, and comprises a heating body comprising a plurality of heat generating layers;

a sensor disposed between two of the heat generating layers of the heating body and integrally formed with the heater, to detect temperatures of the heater from a plurality of sensing positions on the heater, and an insulating member disposed between one of the heat generating layers of the heating body and the sensor;

wherein the sensor comprises an array of sensing units connected in parallel, each sensing unit detecting temperatures of one of the plurality of sensing positions, and wherein the sensor generates one sensing signal based upon plural detected temperatures.

9. The image forming apparatus of claim 8, wherein the switch controls the on/off status of the heater based on comparison between the average temperature information generated by the sensor and a reference temperature.

10. The image forming apparatus of claim 9, wherein the switch controls the on/off driving of the heater so that the average temperature corresponds to the reference temperature.

11. The image forming apparatus of claim 8, further comprising a single analog-to-digital converter provided between the sensor and the switch, to convert the average temperature information into digital signal.

12. The image fixing apparatus of claim 8, wherein the pair of fixing rollers form a fixing nip and the heater housed inside the at least one of the pair of fixing rollers is located between an axis of the at least one of the pair of fixing rollers and the fixing nip.

13. The image fixing apparatus of claim 12, wherein the heater is elongated in an axial direction of the at least one of the pair of fixing rollers and wherein the sensor comprises sensing units that detect temperatures of a center, a first end and a second end of the heater.

* * * * *